US012410676B2

(12) United States Patent
Gupta et al.

(10) Patent No.: US 12,410,676 B2
(45) Date of Patent: Sep. 9, 2025

(54) PACKER ASSEMBLY WITH AN ANTI-EXTRUSION ASSEMBLY

(71) Applicant: Schlumberger Technology Corporation, Sugar Land, TX (US)

(72) Inventors: Susheel Kumar Gupta, Rosharon, TX (US); Farshad Odakkal, Rosharon, TX (US); Oscar V. Rodriguez, Rosharon, TX (US); Richard James Windslow, Rosharon, TX (US); Swarnajay Mukherjee, Waukesha, WI (US); Anshum Jain, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/714,495

(22) PCT Filed: Dec. 5, 2022

(86) PCT No.: PCT/US2022/051835
§ 371 (c)(1),
(2) Date: May 29, 2024

(87) PCT Pub. No.: WO2023/107383
PCT Pub. Date: Jun. 15, 2023

(65) Prior Publication Data

US 2025/0027378 A1 Jan. 23, 2025

(30) Foreign Application Priority Data

Dec. 9, 2021 (IN) ..... 202121057236

(51) Int. Cl.
*E21B 33/12* (2006.01)
*E21B 33/128* (2006.01)

(52) U.S. Cl.
CPC ..... *E21B 33/1216* (2013.01); *E21B 33/128* (2013.01)

(58) Field of Classification Search
CPC ..... E21B 33/128; E21B 33/1216
See application file for complete search history.

(56) References Cited

U.S. PATENT DOCUMENTS 5,678,635 A 10/1997 Dunlap et al.
7,584,787 B2 9/2009 Saltel
(Continued)

FOREIGN PATENT DOCUMENTS

WO 2020163301 A1 8/2020

OTHER PUBLICATIONS

International Search Report and Written Opinion issued on Apr. 18, 2023 in PCT Application Appl. PCT/US2022/051835.

*Primary Examiner* — David Carroll
(74) *Attorney, Agent, or Firm* — Jeffrey D. Frantz

(57) ABSTRACT

A packer assembly for use within a wellbore. The packer assembly may include a mandrel, a seal assembly disposed about the mandrel, an anti-extrusion assembly disposed about the mandrel proximate the seal assembly to prevent extrusion of the seal assembly, and a deployment system. The anti-extrusion assembly may include a cradle cone that may include a plurality of arcuate surfaces on an exterior of the cradle cone and a plurality of cradle arms. Each cradle arm may include a flexible tip and be positioned on a respective arcuate surface of the cradle cone. The deployment system may be operable to compress the seal assembly such that the seal assembly seals against a wellbore wall and to rotate the plurality of cradle arms such that the flexible tips of the cradle arms contact the wellbore wall to prevent extrusion of the seal assembly.

14 Claims, 5 Drawing Sheets

(56) References Cited

U.S. PATENT DOCUMENTS

| | | | | |
|---|---|---|---|---|
| 2004/0069502 | A1 | 4/2004 | Luke | |
| 2014/0262351 | A1* | 9/2014 | Derby | E21B 33/1216 166/387 |
| 2015/0060088 | A1* | 3/2015 | Goodman | E21B 33/1285 166/387 |
| 2016/0076333 | A1* | 3/2016 | Atkins | E21B 33/126 166/387 |
| 2018/0087346 | A1* | 3/2018 | Rochen | E21B 33/128 |
| 2018/0334879 | A1 | 11/2018 | Yue et al. | |
| 2021/0140265 | A1* | 5/2021 | Mitchell | E21B 33/1216 |
| 2022/0106854 | A1* | 4/2022 | Mitchell | E21B 23/06 |

* cited by examiner

PACKER ASSEMBLY WITH AN ANTI-EXTRUSION ASSEMBLY

CROSS-REFERENCE TO RELATED APPLICATIONS

This application is a national stage entry under 35 U.S.C. 371 of International Application No. PCT/US2022/051835, entitled "PACKER ASSEMBLY WITH AN ANTI-EXTRUSION ASSEMBLY," filed Dec. 5, 2022, which claims the benefit of Indian Patent Application number 202121057236, entitled "High Expansion Cradle Shaped Anti-Extrusion Ring and Ax Type Elastomeric Seal for Bridge Plugs, Packer, or Frac Plug," filed Dec. 9, 2021, the disclosure of which is incorporated herein by reference in its entirety.

BACKGROUND

Hydrocarbons produced from a subterranean formation oftentimes have sand or other particulates disposed therein. As the sand is undesirable to produce, many techniques exist for reducing the sand content in the hydrocarbons. Gravel packing is one technique used to filter and separate the sand from the hydrocarbons in a wellbore. Gravel packing generally involves pumping a gravel slurry, including gravel dispersed within a carrier fluid, down a work string and into the annulus formed between a completion assembly and the wall of the wellbore. The gravel is used to filter and separate the sand from the hydrocarbons as the hydrocarbons flow from the formation, into a completion assembly, and up to the surface.

One or more packers are oftentimes set or actuated prior to gravel packing. Upon actuation, the packers expand radially outward into contact with the wall of the wellbore to isolate different layers or zones of the formation. Isolating the different zones prevents the cross-flow of fluids (e.g., hydrocarbon fluids such as oil or gas) between the different zones and reduces the amount of water produced from the formation.

SUMMARY

A packer assembly for use within a wellbore according to one or more embodiments of the present disclosure includes a mandrel, a seal assembly disposed about the mandrel, an anti-extrusion assembly disposed about the mandrel proximate the seal assembly to prevent extrusion of the seal assembly, and a deployment system. The anti-extrusion assembly includes a cradle cone including a plurality of arcuate surfaces on an exterior of the cradle cone and a plurality of cradle arms. Each cradle arm includes a flexible tip and be positioned on a respective arcuate surface of the cradle cone. The deployment system is operable to compress the seal assembly such that the seal assembly seals against a wellbore wall and to rotate the plurality of cradle arms such that the flexible tips of the cradle arms contact the wellbore wall to prevent extrusion of the seal assembly.

A completion system according to one or more embodiments of the present disclosure includes a tubing string positionable within the wellbore and a packer assembly coupled to the tubing string. The packer assembly includes a mandrel, a seal assembly disposed about the mandrel, an anti-extrusion assembly disposed about the mandrel proximate the seal assembly to prevent extrusion of the seal assembly, and a deployment system. The anti-extrusion assembly includes a cradle cone including a plurality of arcuate surfaces on an exterior of the cradle cone and a plurality of cradle arms. Each cradle arm includes a flexible tip and be positioned on a respective arcuate surface of the cradle cone. The deployment system is operable to compress the seal assembly such that the seal assembly seals against a wellbore wall and to rotate the plurality of cradle arms such that the flexible tips of the cradle arms contact the wellbore wall to prevent extrusion of the seal assembly.

A method of completing a wellbore according to one or more embodiments of the present disclosure includes positioning a packer assembly within a wellbore. The method also includes compressing a seal assembly of the packer assembly via a deployment system of the packer assembly such that the seal assembly seals against a wellbore wall. The method further includes rotating a plurality of cradle arms of an anti-extrusion assembly of the packer assembly via the deployment system such that flexible tips of the cradle arms contact the wellbore wall to prevent extrusion of the seal assembly.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The drawings are as follows.

DETAILED DESCRIPTION

In the following description, numerous details are set forth to provide an understanding of some embodiments of the present disclosure. However, it will be understood by those of ordinary skill in the art that that embodiments of the present disclosure may be practiced without these details and that numerous variations or modifications from the described embodiments may be possible.

In the specification and appended claims: the terms "connect," "connection," "connected," "in connection with," "connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

Figure 1:
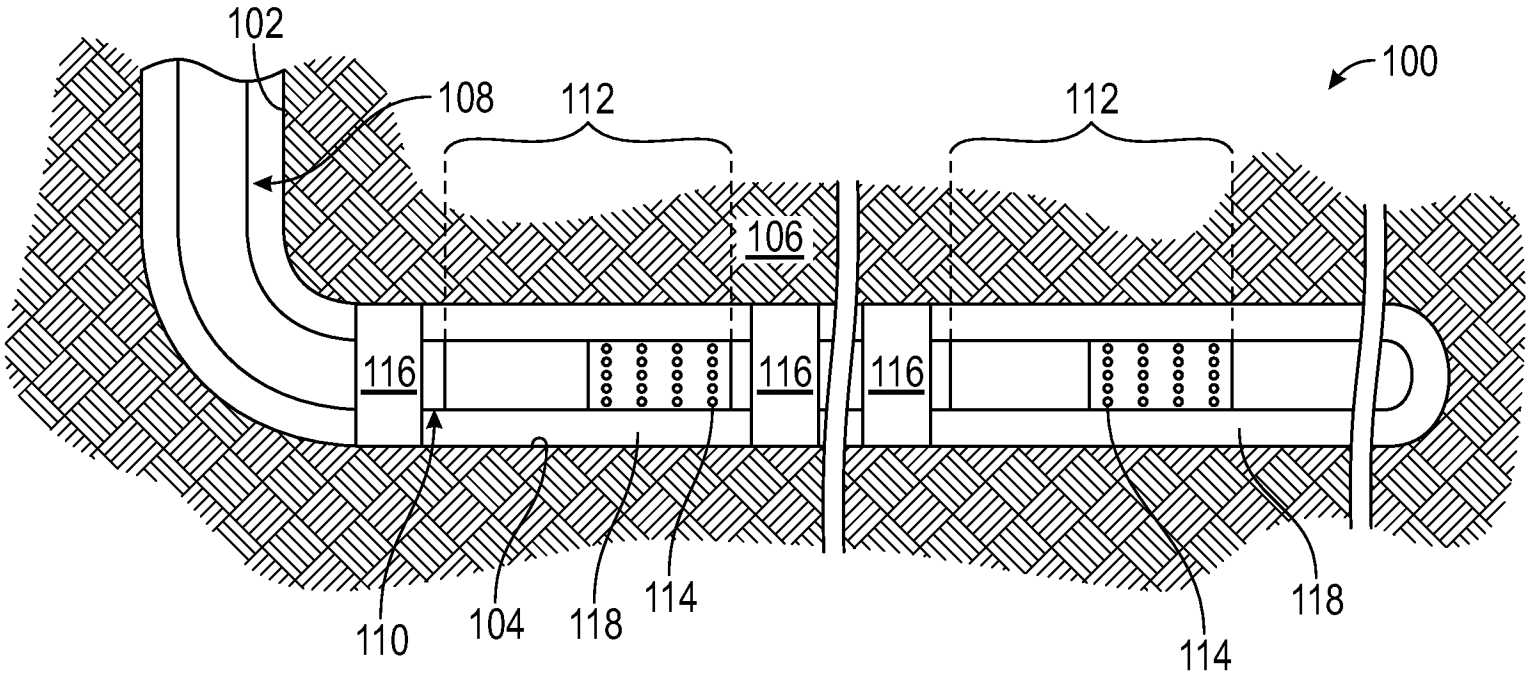
FIG. 1 is a schematic view of a well system according to one or more embodiments of the present disclosure.

Referring now to FIG. 1, FIG. 1 is a well system 100 that includes a wellbore 102 having a deviated wellbore section 104 extending into a formation 106 containing hydrocarbon fluids. Depending on the application, the wellbore 102 may comprise one or more deviated wellbore sections 104, e.g. horizontal wellbore sections, which may be cased or uncased. In the example illustrated, a tubing string 108 is deployed downhole into wellbore 102 and comprises a downhole well completion system 110 deployed in the deviated, e.g. horizontal, wellbore section 104.

The downhole well completion 110 system may be constructed to facilitate production of well fluids and/or injection of fluids. By way of example, the downhole well completion 110 system may comprise at least one sand screen joint 112, e.g. a plurality of screen assemblies 112. Each sand screen joint 112 may include a shroud, e.g. a sand screen, 114 that cover a screen filter through which fluid may enter the corresponding sand screen joint 112 for production to a suitable location, e.g. a surface location. For example, hydrocarbon well fluids may flow from formation 106, into wellbore 102, and into the screen assemblies 112 via the shrouds 114. In some embodiments, the downhole well completion system 110 also may comprise a plurality of packers 116 which may be used to isolate sections or zones 118 along the wellbore 102.

Figure 2:
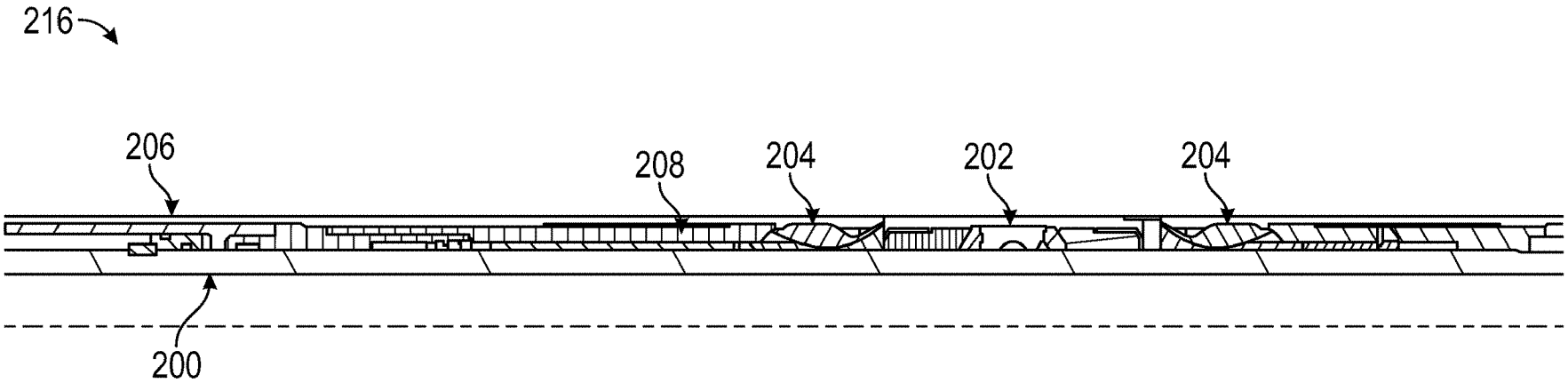
FIG. 2 is a packer assembly according to one or more embodiments of the present disclosure.

Turning now to FIG. 2, FIG. 2 is a packer assembly 216 that includes a tubular mandrel 200, a seal assembly 202 positioned around the mandrel 200, and anti-extrusion assemblys 204 positioned on either side of the element system. The anti-extrusion assemblys 204 are activated via a piston 206 of a deployment system 208, which also compresses the seal assembly 202. The seal assembly 202, when compressed, expands in radial direction to seal an annular space between the packer assembly 216 and a casing or a formation. The deployment system 208 can be actuated via hydrostatic pressure in the well, applying hydraulic pressure from the surface, using a mechanical tool, or any combination thereof.

Figure 3:
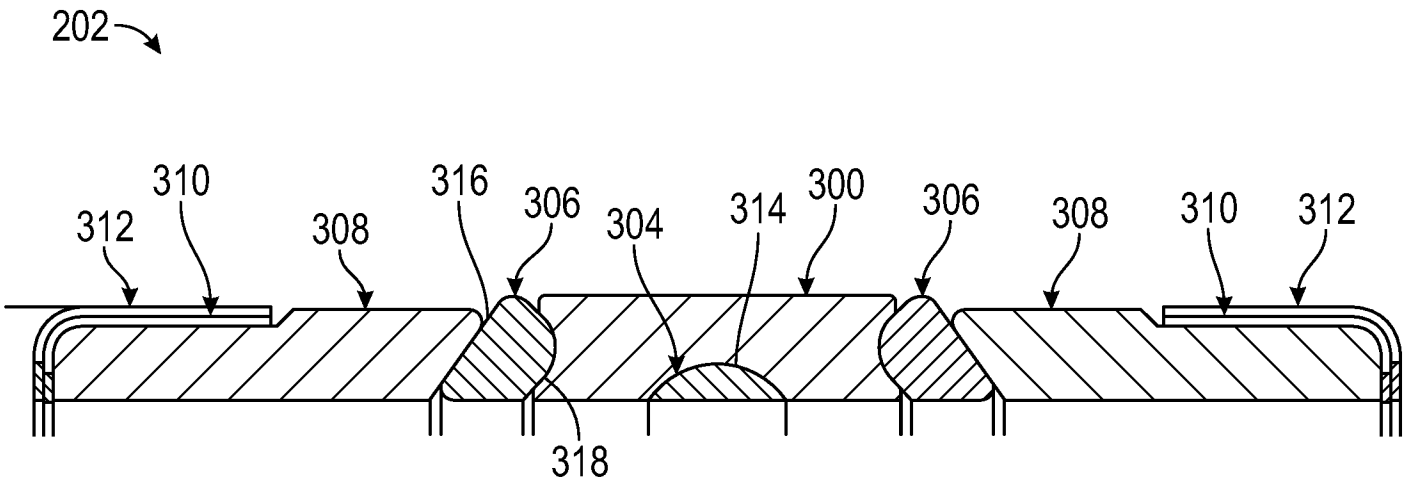
FIG. 3 is a cross-sectional view of a sealing element of the packer assembly of FIG. 2.
Figure 5:
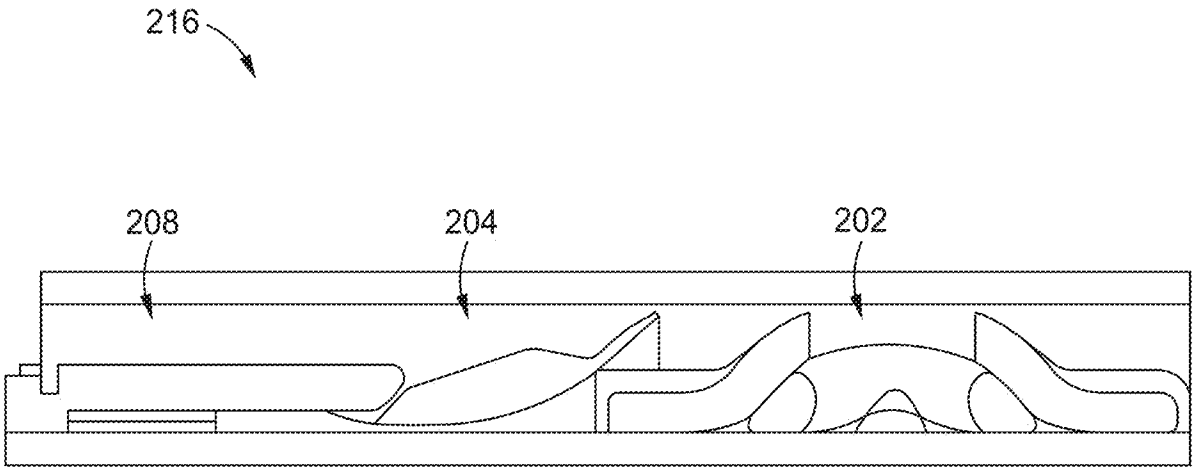
FIG. 5 is a partial view of the packer assembly of FIG. 5 in a partially deployed position.

Turning now to FIG. 3, FIG. 3 is an enlarged view of the seal assembly 202 of FIG. 2. The seal assembly 202 includes multiple sealing elements 300, 304, 306, 308 that are retained via two sets of foldback rings 310, 312. In one or more embodiments, the center sealing element 300 comprises a soft durometer elastomer (e.g., an elastomer having a durometer between approximately 60 and approximately 70) having a cylindrical groove 314 formed on the inner surface adjacent the mandrel 200. The groove 314 is sized and positioned such that the center sealing element 300 will buckle radially outward when compression force is applied to the seal assembly 202, as shown in FIG. 5. An inner sealing element 304 comprises a soft durometer elastomer and is positioned within the groove 314 to reduce or prevent the formation of air or fluid pockets within the seal assembly 202 once the system is set.

In one or more embodiments, wedge elements 306 comprising a hard durometer elastomer (e.g., an elastomer having a durometer of between approximately 80 and approximately 90) are positioned on either side of the center sealing element 300. In other embodiments, the wedge elements 306 may be made of metal, polyether ether ketone ("PEEK"), or any other similar polymer. The wedge elements 306 each include an angled surface 316 on the surface opposite the center sealing element 300 and an arcuate surface 318 contacting the center sealing element 300.

A pair of end elements 308 is positioned adjacent to the angled surface 316 of the wedge elements. In one or more embodiments, the end elements 308 comprise a soft durometer elastomer to allow the end elements 308 to deform within the annular gap between the center sealing element 300 and a tubular or wellbore wall when the seal assembly 202 is compressed and create a seal. The pair of foldback rings 310, 312 are formed from a ductile metal or polymer and partially cover portions of the end elements 308 opposite the wedge elements 306. The foldback rings 310, 312 may deform such that the foldback rings 310, 312 remain in contact with the end elements 308 as the seal assembly 202 is compressed. Further, the foldback rings 310, 312 may each include slots or gaps and be aligned with each other in such a way that one foldback ring 310, 312 covers the slots or gaps in the adjacent foldback ring 310, 312 to reduce or prevent extrusion of the end elements 308.

Figure 4:
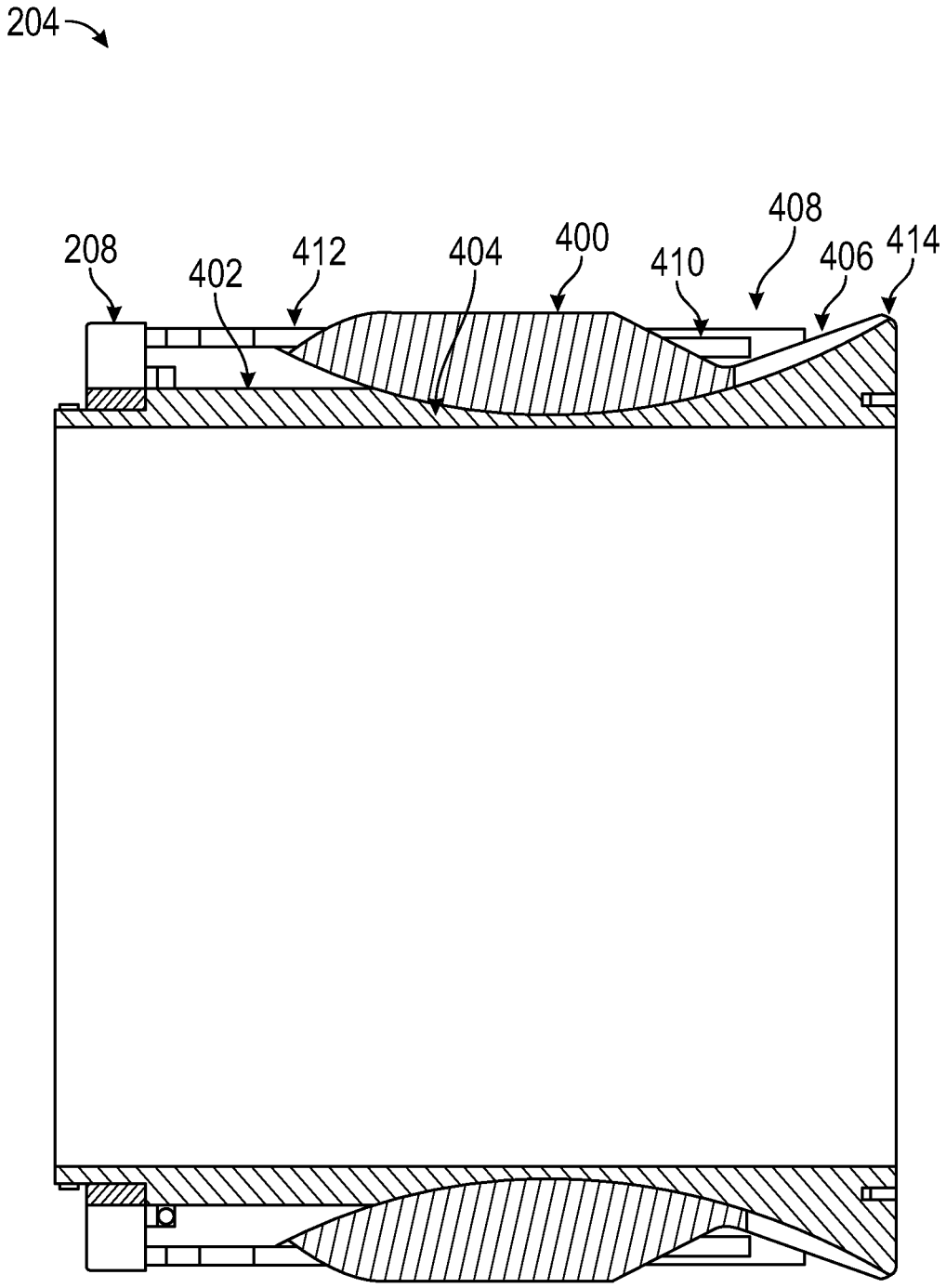
FIG. 4 is a cross-sectional view of the anti-extrusion assembly of FIG. 2.

Turning now to FIG. 4, FIG. 4 is an enlarged view of the anti-extrusion assembly 204 of FIG. 2. The anti-extrusion assembly includes arcuate cradle arms 400 and a cradle cone 402 that includes plurality of arcuate surfaces 404 on the exterior of the cradle cone. Each cradle arm 400 includes a flexible tip 406 that can deform against a casing or wellbore wall. This allows the anti-extrusion assembly 204 to account for ovality and irregularity of the wellbore. The cradle arms 400 are each positioned an arcuate surface 404 of the cradle cone 402 and are retained on the arcuate surface 404 via guides 408 and support members 410, such as leaf springs. Additionally, the support members 410 help to retain the cradle arms 400 in position against a casing or borehole wall once the anti-extrusion assembly 204 has been deployed, as described in more detail below. In one or more embodiments, the anti-extrusion assembly 204 also includes a foldback ring 414 to prevent the premature actuation of the anti-extrusion assembly 204.

In one embodiment, the anti-extrusion assembly 204 includes 20 cradle arms 400 positioned about a cradle cone 402 that includes twenty arcuate surfaces 404. In other embodiments, the anti-extrusion assembly may include less than twenty cradle arms 400 and respective arcuate surfaces 404 or more than twenty cradle arms 400 and respective arcuate surfaces 404.

As discussed above, the anti-extrusion assembly 204 is deployed along with the seal assembly 202 via the deployment system 208. When actuated via the deployment system 208, the cradle arms 400 rotate to contact the casing or wellbore wall, as shown in FIG. 5. Further, the deployment system 208 includes an angled or curved contact surface 412 that is positioned adjacent to the cradle arms 400 to ensure that the deployment system 208 remains in contact with the cradle arms as the cradle arms 400 are actuated.

As used herein, a range that includes the term between is intended to include the upper and lower limits of the range; e.g., between 50 and 150 includes both 50 and 150. Additionally, the term "approximately" includes all values within 5% of the target value; e.g., approximately 100 includes all values from 95 to 105, including 95 and 105. Further, approximately between includes all values within 5% of the target value for both the upper and lower limits; e.g., approximately between 50 and 150 includes all values from 47.5 to 157.5, including 47.5 and 157.5.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A packer assembly for use within a wellbore, the packer assembly comprising:
a mandrel;
a seal assembly disposed about the mandrel, the seal assembly including:
a center sealing element;
a first end element disposed on a first side of the center sealing element and a second end element disposed on a second side of the center sealing element; and
a first wedge element disposed between the first end element and the center sealing element and a second wedge element disposed between the second end element and the center sealing element, each wedge element including an angled top surface;
a first anti-extrusion assembly disposed about the mandrel and adjacent to the first end element and a second anti-extrusion assembly disposed about the mandrel and adjacent to the second end element, each anti-extrusion assembly comprising:
a cradle cone comprising a plurality of arcuate surfaces on an exterior of the cradle cone; and
a plurality of cradle arms, each cradle arm comprising a flexible tip and positioned on a respective arcuate surface of the cradle cone; and
a piston disposed adjacent to the first anti-extrusion assembly and operable to:
rotate the plurality of cradle arms of each anti-extrusion assembly such that the flexible tips of the cradle arms contact a wellbore wall; and
compress the seal assembly such that the first end element slides along the angled top surface of the first wedge element to engage the wellbore wall, the second end element slides along the angled top surface of the second wedge element to engage the wellbore wall, and the center sealing element extends radially towards the wellbore wall.

2. The packer assembly of claim 1, wherein the anti-extrusion assembly further comprises a foldback ring.

3. The packer assembly of claim 1, wherein the anti-extrusion assembly further comprises guides.

4. The packer assembly of claim 1, wherein the anti-extrusion assembly further comprises springs.

5. The packer assembly of claim 1, wherein the center sealing element comprises a groove positioned such that the center sealing element buckles radially outward when compressed.

6. The packer assembly of claim 1, wherein the seal assembly further comprises foldback rings positioned adjacent to the end elements.

7. A completion system for use within a wellbore, the completion system comprising:
a tubing string positionable within the wellbore; and
a packer assembly coupled to the tubing string and comprising:
a mandrel;
a seal assembly disposed about the mandrel, the seal assembly including:
a center sealing element;
a first end element disposed on a first side of the center sealing element and a second end element disposed on a second side of the center sealing element; and
a first wedge element disposed between the first end element and the center sealing element and a second wedge element disposed between the second end element and the center sealing element, each wedge element including an angled top surface;
a first anti-extrusion assembly disposed about the mandrel and adjacent to the first end element and a second anti-extrusion assembly disposed about the mandrel and adjacent to the second end element, each anti-extrusion assembly comprising:
a cradle cone comprising a plurality of arcuate surfaces on an exterior of the cradle cone; and
a plurality of cradle arms, each cradle arm comprising a flexible tip and positioned on a respective arcuate surface of the cradle cone; and
a piston disposed adjacent the first anti-extrusion assembly and operable to:
rotate the plurality of cradle arms of each anti-extrusion assembly such that the flexible tips of the cradle arms contact a wellbore wall; and
compress the seal assembly such that the first end element slides along the angled top surface of the first wedge element to engage the wellbore wall, the second end element slides along the angled top surface of the second wedge element to engage the wellbore wall, and the center sealing element extends radially towards the wellbore wall.

8. The completion system of claim 7, wherein the anti-extrusion assembly further comprises a foldback ring.

9. The completion system of claim 7, wherein the anti-extrusion assembly further comprises guides.

10. The completion system of claim 7, wherein the anti-extrusion assembly further comprises springs.

11. The completion system of claim 7, wherein the center sealing element comprises a groove positioned such that the center sealing element will buckle radially outward when compressed.

12. The completion system of claim 7, wherein the seal assembly further comprises foldback rings positioned adjacent to the end elements.

13. A method of completing a wellbore, the method comprising:
positioning a packer assembly within a wellbore, the packer assembly including:
a seal assembly disposed about a mandrel, the seal assembly including:
a center sealing element;
a first end element disposed on a first side of the center sealing element and a second end element disposed on a second side of the center sealing element; and
a first wedge element disposed between the first end element and the center sealing element and a second wedge element disposed between the second end element and the center sealing element, each wedge element including an angled top surface;
a first anti-extrusion assembly disposed about the mandrel and adjacent to the first end element and a second anti-extrusion assembly disposed about the mandrel and adjacent to the second end element, each anti-extrusion assembly comprising:
a cradle cone comprising a plurality of arcuate surfaces on an exterior of the cradle cone; and
a plurality of cradle arms, each cradle arm comprising a flexible tip and positioned on a respective arcuate surface of the cradle cone; and a piston disposed adjacent the first anti-extrusion assembly and operable to:

rotate the plurality of cradle arms of each anti-extrusion assembly such that the flexible tips of the cradle arms contact a wellbore wall; and compress the seal assembly such that the first end element slides along the angled top surface of the first wedge element to engage the wellbore wall, the second end element slides along the angled top surface of the second wedge element to engage the wellbore wall, and the center sealing element extends radially towards the wellbore wall;

compressing the seal assembly of the packer assembly via the piston such that the seal assembly seals against the wellbore wall; and rotating the plurality of cradle arms of the first and second anti-extrusion assemblies such that flexible tips of the cradle arms contact the wellbore wall to prevent extrusion of the seal assembly.

14. The method of claim 13, wherein compressing the seal assembly further comprises compressing the seal assembly such that a center sealing element of the sealing assembly buckles radially outward.

* * * * *